US010071462B2

(12) United States Patent
Mase et al.

(10) Patent No.: US 10,071,462 B2
(45) Date of Patent: Sep. 11, 2018

(54) METHOD AND DEVICE FOR CUTTING OUT HARD-BRITTLE SUBSTRATE

(71) Applicant: FUJI MANUFACTURING CO., LTD, Tokyo (JP)

(72) Inventors: Keiji Mase, Tokyo (JP); Daisuke Chino, Tokyo (JP); Masato Hinata, Tokyo (JP)

(73) Assignee: FUJI MANUFACTURING CO., LTD., Tokyo (JP)

( * ) Notice: Subject to any disclaimer, the term of this patent is extended or adjusted under 35 U.S.C. 154(b) by 231 days.

(21) Appl. No.: 15/090,875

(22) Filed: Apr. 5, 2016

(65) Prior Publication Data

US 2016/0243673 A1 Aug. 25, 2016

Related U.S. Application Data

(62) Division of application No. 13/874,788, filed on May 1, 2013, now Pat. No. 9,333,624.

(30) Foreign Application Priority Data

May 8, 2012 (JP) ..... 2012-107052
Sep. 3, 2012 (JP) ..... 2012-193245

(51) Int. Cl.
*B24C 1/04* (2006.01)
*B24C 3/18* (2006.01)
*B24C 3/32* (2006.01)

(52) U.S. Cl.
CPC ..... *B24C 3/18* (2013.01); *B24C 1/04* (2013.01); *B24C 1/045* (2013.01); *B24C 3/32* (2013.01)

(58) Field of Classification Search
CPC .... B24C 3/18; B24C 3/02; B24C 3/08; B24C 3/085; B24C 3/086; B24C 3/12; B24C 3/32

(Continued)

(56) References Cited

U.S. PATENT DOCUMENTS 2,092,083 A * 9/1937 Ogle ..... B24C 1/045 451/102
3,693,302 A * 9/1972 Hakes ..... H01L 21/67092 451/31

(Continued)

FOREIGN PATENT DOCUMENTS

CH 614656 A5 * 12/1979 ..... B24C 3/086
DE 1292794 B * 4/1969 ..... B22D 29/006

(Continued)

OTHER PUBLICATIONS

Corresponding Japanese Application No. 2012-193245, Japanese Office action dated Jun. 29, 2016.

*Primary Examiner* — Joseph J Hail
*Assistant Examiner* — Arman Milanian
(74) *Attorney, Agent, or Firm* — Cooper Legal Group LLC; Ronald Kachmarik

(57) ABSTRACT

To cut out a hard-brittle substrate by blasting, laying out substrates 2 on a plate material 1 made of a hard-brittle material with leaving a space for blasting; forming first protective films 4 on both surfaces of the plate material 1 at layout positions of the substrates 2; and forming second protective films 5 on both surfaces of a margin 3 of the plate material 1 with leaving a space with respect to the first protective films 4 and having outer edges from a periphery of the plate material 1 at a width of 5 mm or less; cutting regions 6 between the films 4, 4 and between the films 4, 5 from one surface of the plate material 1 to a depth of approximately half of a thickness thereof by blasting, then cutting from the other surface of the plate material 1 until the plate material 1 is penetrated.

2 Claims, 8 Drawing Sheets

(58) Field of Classification Search
USPC ..... 451/38–41, 57, 75, 78; 125/23.01
See application file for complete search history.

(56) References Cited

U.S. PATENT DOCUMENTS 3,694,972 A * 10/1972 Emeis ..... B24C 3/322 257/E21.239
3,934,375 A * 1/1976 Hornstein ..... B23Q 7/03 451/239
4,656,791 A * 4/1987 Herrington ..... B24C 1/045 451/38
5,415,581 A * 5/1995 Bando ..... C03B 33/03 125/23.01
5,443,412 A * 8/1995 Yoshikawa ..... B23Q 7/041 29/33 P
5,503,673 A * 4/1996 Berta ..... A23G 3/2092 118/16
6,422,920 B1 * 7/2002 Bouten ..... B24C 1/04 451/29
6,757,973 B2 * 7/2004 Park ..... B41J 2/1603 29/890.1
6,966,821 B2 * 11/2005 Okumura ..... B08B 1/04 451/41
8,845,393 B2 9/2014 Mase et al.
2003/0092364 A1 * 5/2003 Erickson ..... B24C 1/045 451/75
2005/0079797 A1 * 4/2005 Marti ..... B24C 1/045 451/5
2009/0124178 A1 * 5/2009 Ueyama ..... B24C 1/045 451/91
2012/0052773 A1 * 3/2012 Mase ..... B24C 1/04 451/38
2012/0135177 A1 * 5/2012 Cornejo ..... B26F 3/002 428/43
2013/0143473 A1 * 6/2013 Hibino ..... B24C 1/086 451/38

FOREIGN PATENT DOCUMENTS

DE 4408645 C1 * 6/1995 ..... B24C 3/083
JP 2012-45651 A 3/2012

* cited by examiner

METHOD AND DEVICE FOR CUTTING OUT HARD-BRITTLE SUBSTRATE

RELATED APPLICATION

Benefit of priority is claimed from U.S. patent application Ser. No. 13/874,788, filed May 1, 2013, which is incorporated herein by reference.

BACKGROUND OF THE INVENTION

1. Field of the Invention

The present invention relates to a method for cutting out a hard-brittle substrate and a cutout device suitable for use in the method, and more particularly to a method and a device for cutting out various substrates from a plate material having hard-brittleness such as glass, quartz, sapphire, ceramics or a silicon wafer for cutting out a substrate such as a glass substrate or a protective cover for a liquid crystal display screen and the like mounted on a personal digital assistance such as a mobile phone, a smartphone or a tablet PC, a digital camera, a portable game machine or other various products from a glass plate (mother glass to be described later).

It should be noted that the "substrate" as employed herein refers to a plate-shaped part on which a functional component is arranged in order to implement some function. More specifically, the "substrate" herein means not only those commonly called "substrates" such as a glass substrate for a liquid crystal display and the like or a substrate made of glass for a magnetic hard disk, but also a cover glass and the like for a cover glass integrated type touch panel and the like provided in a mobile phone and the like and configured to perform the function of protecting a liquid crystal display device and the like disposed on the back side of the cover glass in the touch panel and the like.

2. Description of the Related Art

Glass substrates as a typical example of a hard-brittle substrate are used as substrates for a display of a liquid crystal television or a personal computer, a display of a personal digital assistance such as a mobile phone, a smartphone or a tablet PC, a display of a digital camera, and a flat-panel display for use in other various equipment, and are used as a protective cover for protecting such a display. Besides, glass substrates are also used as the substrate for the above-described hard disk and the like because of having a lower coefficient of expansion and higher shock resistance than a conventional substrate made of aluminum. Thus, the industrial applications of glass substrates are being expanded.

A general practice for obtaining such a glass substrate is to cut out plural substrates from a large-sized glass plate called mother glass. A method for cutting out the substrates typically involves a combination of processes called "scribing" and "breaking." The scribing is a process of making cuts in the mother glass in accordance with the shapes of the substrates to be cut out. The breaking is a process of cutting off the substrates from each other or cutting off the substrates from margins (borders) by applying a bending force to the glass plate in accordance with the cuts made by the scribing.

In this connection, examples of the scribing include scribing by mechanically making cuts by a diamond chip or a diamond roller and the like, and laser scribing utilizing the development of cracks by laser-induced thermal stress by laser irradiation of the glass plate. The laser scribing enables non-contact processing of the glass plate. In addition, the laser scribing can prevent contamination of a workpiece without generating glass cutting powder and the like, and can also prevent deterioration in strength of the glass without developing microcracks in broken and divided surfaces. Thus, cutting out with the laser scribing is coming into general use for the cutting out of the glass substrates in the aforementioned fields such as a flat-panel display.

Here, the cutting out with the already known laser scribing also needs the breaking after the scribing. However, such cutting out has difficulty in high-precision control of the breaking direction and the like of a glass plate during the breaking process, and an end face formed on the glass after the breaking does not always have a cross section with high precision. These problems hinder the use of the laser scribing for cutting out a minute substrate, the cutout of a substrate having a curved line, or the cutting out of a substrate from multilayer structure glass, somewhat thick plate glass, reinforced glass and the like. Taking this hindrance into account, there has also been a proposal of laser scribing called "full cut," which enables the laser scribing to form scribing not only in the vicinity of a surface of a glass plate but also throughout the thickness of the plate, thereby eliminating the need for a breaking process (refer to Japanese Patent KOKAI (LOPI) No. 2006-256944).

Meanwhile, blasting which involves ejection of abrasive grains together with compressed gas against a surface to be processed of a workpiece is publicly known as a type of cutting, and there has also been a proposal of the use of such blasting for formation of barrier ribs (formation of grooves) in a glass substrate for a plasma display panel (refer to Japanese Patent KOKAI (LOPI) No. 2000-215795).

Although the cutout of a substrate by the above-described laser scribing needs the introduction of an expensive laser scribing apparatus and hence needs a lot of initial investments, the cutting out by this method is commonly said to have the advantage of eliminating a need for a mechanical polishing operation for an end face of a cut-out substrate, because the cutting out causes no microcrack development in the end face of the cut-out substrate and, moreover, forms the end face into a mirror surface.

Even if the end face of the cut-out substrate is the mirror surface, however, a brittle glass substrate is very easily damaged in its portions having a sharp shape including edges or corner portions formed on its periphery.

Therefore, cracks such as large or small cracks or chipped sections tend to occur in the edges or the corner portions of substrates by contact of one substrate with another or contact with working tools and the like during transportation or during processing. Occurrence of such cracks or chipped sections will be collectively referred to as "chipping" hereinafter. Once such chipping occurs in a substrate, the substrate is fractured from the position of the chipping merely by applying a slight force in a bending direction.

Also, a substrate having sharp edges or corner portions remaining therein is dangerous and hence needs careful handling during assembly operation and the like. In addition, the obtained substrate also involves the risk of injuring a user, if the substrate is mounted in such a way that the edges or corner portions of the substrate assembled in a final product may come into contact with the user's hands or fingers, such for example as when the substrate is used as a cover glass for a liquid crystal display screen and the like.

In almost all cases, therefore, even the substrate cut out by the laser scribing needs an operation, such as what is called "light-chamfering" or "chamfering," for removing the edges or the corner portions by subjecting a peripheral portion of the cut-out substrate to mechanical polishing and the like. Among advantages commonly said for the laser scribing, the advantage of eliminating the need to polish the end face can be enjoyed in rather limited situations.

In contrast, if blasting is used for cutting out a brittle material substrate such as glass, a blasting apparatus of relatively simple structure can be used for cutting out. Having no need to introduce expensive equipment such as the laser scribing apparatus, the cutting out with the blasting is expected to start with low initial investments.

Although a conventional art in which the blasting is used to form the barrier ribs in the glass substrate for the plasma display panel is existed as mentioned above (refer to Japanese Patent KOKAI (LOPI) No. 2000-215795), the blasting has not been applied to "cut out" a glass substrate so far. The possible reason why the blasting is not used to cut out the glass substrate as described above is that etching by the blasting cannot be used for scribing.

Specifically, even if grooves are formed by blasting in a surface of mother glass in accordance with the shape of substrates to be cut out in order to perform breaking along the grooves, the grooves formed by the blasting are round at their bottom surfaces unlike V-shaped cuts formed by a diamond chip or a diamond roller and the like. For this reason, the mother glass is not easily broken and cut even with the application of a force to the mother glass in the bending direction. Or, even if the mother glass can be broken and cut, the mother glass cannot necessarily be cut with precision along the grooves formed by the blasting. Hence, the blasting cannot be used instead of the already known scribing.

Therefore, the use of the blasting for cutting out the glass substrate needs cutting such that the grooves are formed not only in the vicinity of the surface of the mother glass but also throughout the thickness of the mother glass until the grooves pass through the mother glass.

Under the above preconditions, in order to further verify the possibility of the use of blasting for cutting out a glass substrate, the inventor of the prevent invention made an attempt to cut out substrates by laying out the cutout positions of substrates 120 on a mother glass 100 as illustrated in FIG. 8, masking the mother glass by adhesively bonding blast-resistant protective films 104 to the layout positions of the substrates 120 on one surface alone or front and back surfaces of the mother glass, and cutting away the mother glass 100 in portions where the protective films 104 are not attached, by ejecting abrasive grains together with compressed air from an ejection nozzle.

However, when the blasting was continuously performed to complete such cutting, cracks 131 developed as illustrated in FIG. 8 in a margin 130 (a portion commonly called a "border") formed on the outer periphery of the layout positions of the substrates, accordingly, the substrates cannot be cutout.

Moreover, in the case of the cutting by the blasting from the front and back surfaces of the mother glass 100, an operation for turning over the mother glass 100 or doing the like is necessary in the course of processing. In this case, even if the margin 130 can be prevented from becoming cracked during the blasting, a force in the bending direction is applied to the mother glass 100 in the course of turning over the mother glass 100, and the mother glass 100 breaks from a thinned portion.

As described above, although the cutting by the blasting is expected to enable the cutout of a hard-brittle material substrate with low initial investments because the blasting can be implemented with a simpler apparatus configuration than the laser scribing apparatus and the like, simple application of the blasting to the cutout of the glass substrate resulted merely in causing damage to the mother glass.

The above description is provided for the cutout of the glass substrate as an example of the brittle material substrate, however the same problem arises also with a plate material such as quartz, sapphire, ceramics or a silicon wafer which is hard and brittle like glass, and the cutout of the substrate is not possible with the simple application of the blasting.

Therefore, an object of the present invention is to provide a cutout method capable to cut out a brittle material substrate without causing damage to a plate material made of a hard-brittle material during operation by blasting which has not hitherto been used as a method for cutting out the brittle material substrate, such as the cutout of a glass substrate for a personal digital assistance or a flat-panel display, and to provide a cutout device suitable for use in cutout by the method.

SUMMARY OF THE INVENTION

As already known, a glass substrate is obtained by cutting out plural substrates from a large-sized glass plate called mother glass. In the present invention, a method for cutting out the substrates involves a combination of processes called "scribing" and "breaking." The scribing is a process of making cuts in the mother glass corresponding to cutting regions 6 provided along outer edges of the first protective films 4 masked in accordance with the shapes of the substrates 2 to be cut out. The breaking is a process of cutting off the cutting regions between the substrates from each other or cutting off the substrates from margins (borders), i.e., residues produced by cutting off including the part masked with the second protective films 5 by applying a bending force to the glass plate in accordance with the cuts made by the scribing.

Means to solve the above problems will now be described below with reference numerals used in the detailed description of the preferred embodiments. The reference numerals are intended to clarify correspondence between description of the claims and description of the preferred embodiments for carrying out the invention, and needless to say, are not restrictively used for understanding the technical scope of the present invention.

In order to achieve the above objectives, a method for cutting out a hard-brittle substrate according to the present invention comprises:

laying out a plurality of first protective films 4 with blast-resistant property having shapes corresponding to a plurality of substrates 2 to be cut out on a plate material 1 made of a hard-brittle material which is the mother glass with leaving cutting regions 6 required for cutting by blasting, and forming second protective films 5 with blast-resistant property on outer edges of the substrates 2 with leaving the cutting regions 6, and covering a margin (border) 3 of the plate material 1 with the second protective film 5 so that an exposed width in a peripheral portion of the plate material 1 is equal to or less than 5 mm;

setting the cutting regions 6 on the regions of which having no first and second protective films 4, 5 formed between the first protective films 4, 4, and between the first protective film 4 and the second protective film 5; forming the first protective films 4 and the second protective films 5 on front and back surfaces of the plate material 1 at the same positions so as to opposite each other; and cutting the cutting regions 6 from either one surface of the plate material 1 to a depth of approximately half of a plate thickness of the plate material 1, then cutting the cutting region 6 from the other surface of the plate material 1 until communicating with a cut portion from said one surface of the plate material 1.

In the method for cutting out a hard-brittle substrate with the above configuration, widths δ1, δ2 of the cutting region 6 are equal to or less than 5 mm, preferably 3 mm to 2 mm.

The cutting region 6 of the plate material 1 may be cut to a depth of approximately a half of the plate thickness by blasting from a back surface side of the plate material 1 in a state that the plate material 1 is floated by fixing by suction a front surface of the plate material 1, then portions where the first protective films 4 are formed in the back surface of the plate material 1 may be mounted and fixed by suction on suction fixing bases for substrates 41 with plane shapes respectively corresponding to the substrates 2, and the margin 3 where the second protective films 5 are formed may be mounted on a margin base 42 to cut the cutting region 6 by blasting from a front surface side of the plate material 1.

As a result of experiments by the inventor of the present invention, it has been found out that, when an abrasive selected from silicon carbide, aluminum oxide, zircon, zirconia, diamond, cerium oxide, stainless steel, cast steel, alloy steel, high-speed steel, tungsten carbide or FeCrB has a hardness of Hv 700 to Hv 9000, a true specific gravity of 3.0 to 15.3 and a median diameter of 20 μm to 100 μm, preferably 30 μm to 60 μm, and the abrasive is ejected under a processing condition, i.e., at an ejection speed of 100 m/s to 250 m/s or at an ejection pressure of 0.2 MPa to 0.5 MPa, and when the abrasive of substantially spherical shape is used, the speed for cutting out the substrates 2 can be increased while processing accuracy (accuracy of cutout dimension) is maintained, and also, the thicknesses of the protective films can be reduced by reducing damage to the protective films at the time of collision with the abrasive.

A device 10 for cutting out a hard-brittle substrate is characterized that:

a plurality of substrates 2 to be cut out from a plate material 1 made of a hard-brittle material is laid out on the plate material 1 with leaving a space which is required for cutting by blasting; first protective films 4 with blast-resistant property are formed on each of front and back surfaces of the plate material 1 at a position where each of the substrates 2 is laid out; second protective films 5 with blast-resistant property are formed on outer edges of the substrates 2 with leaving a space which is required for cutting by blasting; a margin (border) 3 of the plate material 1 is covered so that an exposed width in a peripheral portion of the plate material 1 is equal to or less than 5 mm thereby the plate material 1 is a subject to be processed; and the device 10 comprises:

a plate material suspension jig 30 including a suction fixing plate 31 for fixing by suction the front surface of the plate material 1 and holding the plate material 1 fixed by suction to the suction fixing plate 31 in a state that the plate material 1 is floated in midair;

an ejection nozzle for back surface processing 51 configured to eject abrasives to the back surface of the plate material 1 suspended by the plate material suspension jig 30;

a plate material mounting jig 40 for mounting the plate material 1 after blasting from the back surface of the plate material 1, the plate material mounting jig 40 including: a plurality of suction fixing bases for substrates 41 with plane shapes corresponding to the substrates 2 to be cut out, configured to fix by suction and mount thereon portions which are covered with the first protective films 4 in the back surface of the plate material 1; and a margin base 42 disposed at an outer periphery position of a group of the plurality of suction fixing bases for substrates 41, configured to mount thereon the portions which are covered with the second protective film 5 in the plate material 1; and an ejection nozzle for front surface processing 52 configured to eject abrasives to the front surface of the plate material 1 mounted on the plate material mounting jig 40.

The device 10 for cutting out a hard-brittle substrate is characterized that the plate material suspension jig 30 includes an up-and-down movement mechanism 32 and a horizontal movement mechanism 33 for the suction fixing plate 31, the plate material mounting jig 40 includes a travel means (pedestal 43 in FIG. 2), and the device 10 further comprises a control unit (not shown) to cause the units to perform operation in which: the plate material suspension jig 30 lowers the suction fixing plate 31 from a starting position (position 12*b* in FIG. 2) thereof and causes the suction fixing plate 31 to fix by suction the plate material 1 placed below the starting position; then the plate material suspension jig 30 moves horizontally with the suction fixing plate 31 moved up thereby to pass above the ejection nozzle 51 for back surface processing configured to eject the abrasive; then the plate material suspension jig 30 moves to a position above the plate material mounting jig 40, and lowers the suction fixing plate 31 at the position thereby to mount the plate material 1 on the plate material mounting jig 40, and thereafter release the suction by the suction fixing plate 31; and the plate material mounting jig 40 starts to fix by suction the plate material 1, and travels and passes below the ejection nozzle for front surface processing 52 configured to eject the abrasive.

In an instance where the abrasive of substantially spherical shape is used, when the hardness of the abrasive is lower than 700 Hv, the shape of the abrasive becomes deformed by collision, which in turn leads to the problem of causing deterioration in cutout ability and the processing accuracy. Also, when the true specific gravity is set less than 3.0, high collision energy cannot be concentrated on one point (narrow range), which in turn causes the problem that a hard-brittle material such as glass cannot be cut out with the abrasive of substantially spherical shape. Meanwhile, when the hardness of the abrasive is higher than 9000 Hv, a breaking force to a brittle material becomes too large and hence the plate material 1 may become damaged, and moreover, the abrasive having a hardness of more than 9000 Hv is not practical in terms of costs. When the true specific gravity of the abrasive exceeds 15.3, chipping occurred in a cut-out outer peripheral portion becomes large, and in addition, a mask becomes damaged.

Also, when the median diameter is set larger than 100 μm, the chipping in the cut-out outer peripheral portion becomes large and, in addition, the protective films cannot completely absorb impact at the time of collision with the abrasive, which in turn leads to the problem of causing damage to a workpiece to be processed, located under the protective films. When the thicknesses of the protective films are increased in order to address the problem, the processing accuracy deteriorates and the costs rise. Meanwhile, when the median diameter is smaller than 20 μm, the cutout speed becomes low, which in turn causes the problem of reducing productivity.

Also, when the ejection speed is lower than 100 m/s or the ejection pressure is lower than 0.2 MPa in an instance where the median diameter of the abrasive lies between 20 μm and 100 μm, the collision energy becomes low and hence the cutout ability deteriorates significantly, which in turn further causes the problem that cutting out of the hard-brittle material becomes quite impossible. Meanwhile, when the ejection speed is higher than 250 m/s or the ejection pressure is higher than 0.5 MPa, the collision energy becomes too high, which in turn leads to the problem of causing deterioration in the processing accuracy (the accuracy of cutout dimension), and moreover, there arises a need to increase the thicknesses of the protective films in order to increase durability of the protective films, thus raising the costs.

By the configuration of the present invention described above, according to the method for cutting out a hard-brittle substrate and the device 10 for cutting out a hard-brittle substrate of the present invention, the following marked effects can be achieved.

The plate material 1 made of the hard-brittle material is not only masked with the first protective films 4 at layout positions of the substrates 2 but also masked with the second protective film 5 in the margin (border) 3, and the second protective film 5 is formed in such a manner that the width (see the exposed width W in an enlarged view of FIG. 1) of a peripheral portion of the plate material 1 not covered with the protective film (the second protective film) is equal to or less than 5 mm, and the portion which is formed between the first protective films 4, 4 and between the first protective film 4 and the second protective film 5 and is not covered with the protective films is set as the cutting region 6, and the plate material 1 is cut from the front and back surfaces thereof respectively. Thereby, even when the cutting by the blasting is continuously performed to cut out the substrates 2 until penetrating the plate material 1 made of the hard-brittle material, cutout can be carried out without cracks developing in the plate material 1.

Particularly if the widths δ1, δ2 of the cutting region 6 are set large when the thickness of the cutting region is reduced as the cutting by the blasting proceeds, cracks are likely to develop in the cutting region 6 and the cracks extend to the layout positions of the substrates 2 or do the like, which in turn makes it impossible to cut out the substrates 2. In the configuration in which the widths δ1, δ2 of the cutting region 6 are set equal to or less than 5 mm, preferably set to 3 mm to 2 mm, however, such crack development in the cutting region 6 can also be suitably prevented.

A configuration is such that the cutting region 6 is cut to a depth of about half of the plate thickness by blasting the plate material 1 from its bottom surface side in a state that the plate material 1 is floated by fixing by suction the front surface of the plate material 1 by the suction fixing plate 31 of the plate material suspension jig 30, and thereafter, the plate material 1 is mounted on the plate material mounting jig 40 and the portions of the back surfaces of the plate materials 1 which are respectively covered with the first protective films 4 are mounted and fixed by suction on the suction fixing bases for substrates 41, and the portions of the back surfaces of the plate materials 1 covered with the second protective film 5 are mounted on the margin base 42, then the cutting region 6 is cut from the front surface of the plate material 1. Also, the control unit (not shown) performs predetermined control on operations for ejecting the abrasive by the plate material suspension jig 30, the plate material mounting jig 40 and the ejection nozzles 51, 52, thereby, even the plate material 1 made of the hard-brittle material can be processed from the front and back surfaces with relative ease without becoming damaged, and the plate material can be more reliably prevented from being fractured in the course of processing.

Moreover, the cut-out brittle material substrates 2 are mounted by being fixed by suction on the suction fixing bases for substrates 41, and thus, the positions of the cut-out substrates 2 can be fixed with reliability and hence the disadvantage of the cut-out substrates 2 becoming damaged by colliding with each other or doing the like can also be suitably prevented from arising.

Also, the abrasive to be ejected by the blasting, selected from silicon carbide, aluminum oxide, zircon, zirconia, diamond, cerium oxide, stainless steel, cast steel, alloy steel, high-speed steel, tungsten carbide or FeCrB has a hardness of Hv 700 to Hv 9000, a true specific gravity of 3.0 to 15.3 and a median diameter of 20 μm to 100 μm, and the abrasive of substantially spherical shape is ejected to the plate material 1 made of the hard-brittle material at an ejection speed of 100 m/s to 250 m/s or at an ejection pressure of 0.2 MPa to 0.5 MPa. Thereby, the speed for cutting out the substrates 2 can be increased while the processing accuracy (the accuracy of cutout dimension) is maintained, and also the thicknesses of the protective films can be reduced by reducing damage to the protective films at the time of collision with the abrasive.

BRIEF DESCRIPTION OF THE DRAWINGS

The objects and advantages of the invention will become apparent from the following detailed description of preferred embodiments thereof provided in connection with the accompanying drawings in which.

DETAILED DESCRIPTION OF THE PREFERRED EMBODIMENTS

Next, embodiments of the present invention will be described below with reference to the drawings.

Workpiece

In the present invention, a workpiece as a subject to be processed is a plate material formed of a material which may be easily cracked and fractured by impact during processing, as a result of having the brittleness of being lacking in toughness or doing the like although it is hard.

Examples of such a material include glass, quartz, ceramics and sapphire, and any of these is a subject to be cut out by the present invention, and may be expected to be used particularly for a glass substrate to be industrially mass-produced as a substrate for a personal digital assistant or a panel display, a substrate for a hard disk, and the like.

Further, such glass is not particularly limited, however, soda glass, soda lime glass, alkali glass, non-alkali glass, and high-strain-point glass which are used in substrates for flat panel displays, aluminosilicate glass and crystallized glass, which are used in substrates for hard disks, borosilicate glass (heat-resistant glass), potash glass, crystal glass, quartz glass, tempered glass and the like may be a subject to be polished by the present invention.

Although the cutout of a substrate generally involves subjecting large-sized glass called mother glass as it is to manufacture without cutting the mother glass, for example, glass plates obtained by dividing the mother glass into a predetermined number of portions may be further cut out into individual substrates.

Formation of Protective Film

The substrates 2 to be cut out are laid out by blanking (plate cutting) on the plate material 1 of the hard-brittle material and the first and second protective films 4, 5 are formed on each of the front and back surfaces of the plate material 1 according to layout positions of the substrates 2 determined by the blanking.

Figure 1:
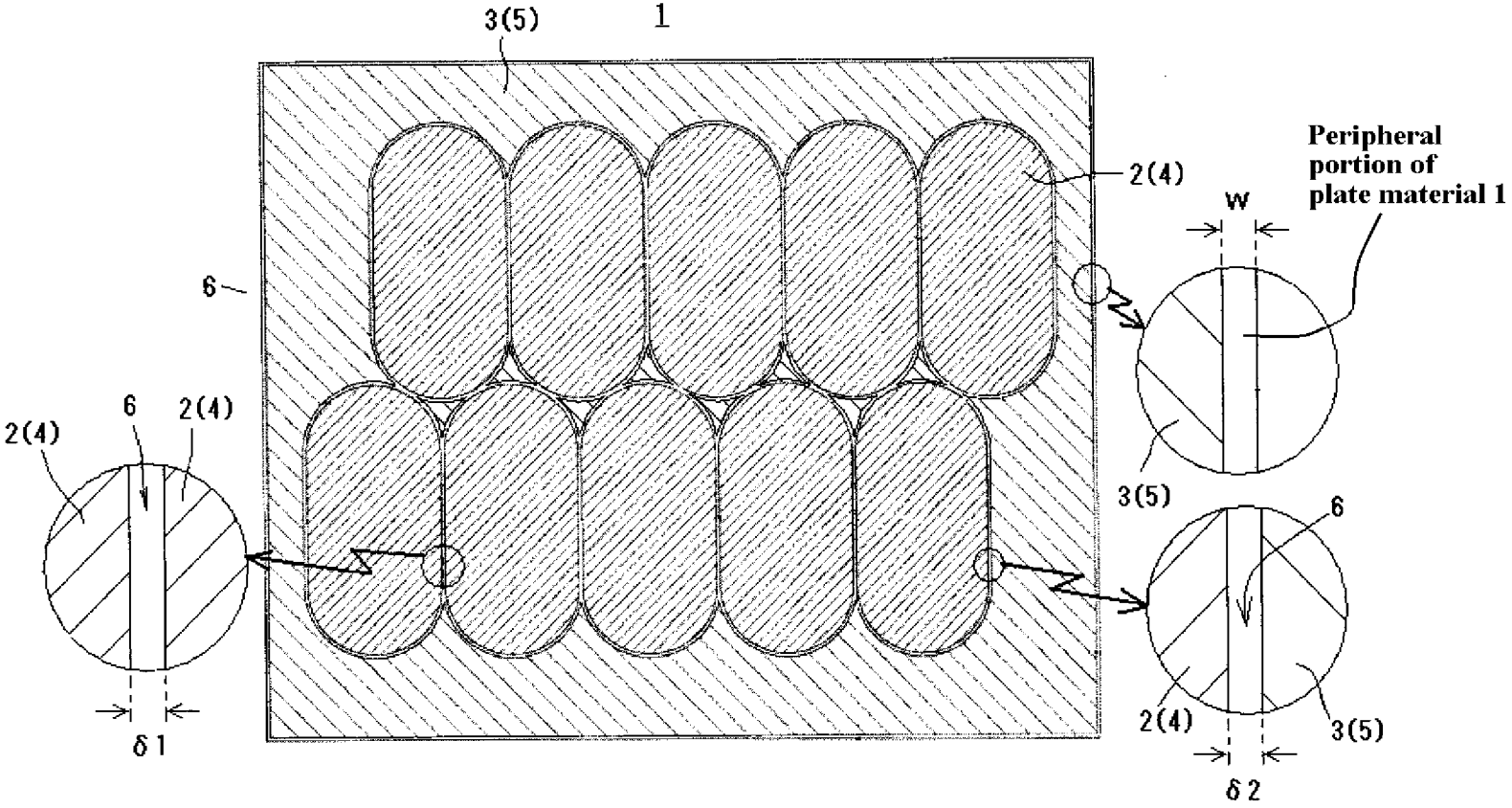
FIG. 1 is a plane view of a plate material made of a hard-brittle material.

The shape of the substrate 2 to be cut out from the plate material 1 of the hard-brittle material is not limited to a shape formed by straight lines alone such as a rectangular shape, but may be a shape having curved lines such as a shape similar to an eclipse having semicircular ends of a rectangle in its longitudinal direction as illustrated in FIG. 1, and further, the shape of the substrate 2 may be a more complicated shape, and further, the substrate 2 may be provided with an opening and the like.

The layout is set so that a space δ1 between the adjacent substrates 2, 2 has a space (cutting allowance by blasting) required for cutting by the blasting.

The cutting allowance varies according to the particle diameter of an abrasive used and the like, however, the cutting allowance is required to be about 1 mm, and if the space between the substrates 2, 2 is too small, during the processing by the blasting, a portion to be left as the substrate 2 is also eroded, and the substrate 2 cannot be cut out in a desired shape.

Meanwhile, if the width is too large, cracks may develop during cutting, and the cutting requires a long time, thus the space δ1 is set to 5 mm or less, or preferably set to 2 mm to 3 mm.

On each of the front and back surfaces of the plate material 1, the first protective films 4 having blast-resistant property are formed at the layout positions of the substrates 2 according to layout of the substrates 2 determined by blanking as described above, and the second protective film 5 likewise having blast-resistant property is formed in the margin 3 formed on the outer periphery of the substrates 2 laid out as described above.

Here, the first protective film 4 is served for protecting the substrate to be cut out so that the substrate 2 is not cut by the blasting, and thus, the first protective film 4 is formed in a shape corresponding to the shape of the substrate 2 to be cut out.

On the other hand, the margin 3 which remains after the substrate 2 has been cut out, i.e., residues produced by cutting off including the part masked with the second protective films 5 is a portion which is not used as a product, and even if this portion is cut by the blasting during cutout, no problem arises in term of quality of the product, and therefore, this portion inherently requires no particular protection.

However, as a result of trials and errors by the inventor, the protective film (the second protective film) 5 is formed also in the margin 3 which does not originally required masking and protection with leaving a space required to cut the peripheral portion of the first protective film 4 inbetween, and the margin 3 is protected by the second protective film 5 in such a manner that the exposed width W in the peripheral portion of the plate material 1 is equal to or less than 5 mm, thereby the occurrence of cracks in the margin 3 can be significantly prevented as described in the summary of the invention.

Therefore, the second protective film 5 formed in the margin 3 is not required to be formed in the shape corresponding accurately to the shape of the margin 3 like the first protective film 4, however, the shape of its outer periphery is formed at least in such a manner that the exposed width W in the peripheral portion of the plate material 1 is equal to or less than 5 mm.

Also, if the space δ2 between the second protective film 5 and the first protective film 4 is formed equal to or less than the space required for the cutting by the blasting (the space required as the cutting allowance), a portion to be left as the substrate 2 during the blasting is cut, and the substrate 2 cannot be accurately cut out, and thus, the space δ2 is also set to the space required for the cutting by the blasting, 1 mm to 5 mm by way of example or preferably 2 mm to 3 mm, same as the space δ1 provided between the substrates 2, 2.

In the plate material 1 on which the first and second protective films 4, 5 are formed, the space δ1 formed between the first protective films 4, 4 and the space δ2 formed between the first protective film 4 and the second protective film 5 are a cutting region 6 to be cut away by the blasting.

When a relatively wide space is formed between curved line portions of the first protective film 4 as is the case when the substrate 2 has a curved line portion as illustrated in FIG. 1, also for the portion between curved line portions, the second protective film 5 is formed with leaving a distance required for cutting from the peripheral portion of the first protective film 4, thereby, in any portion, the cutting region 6 is formed so as to have a space of 1 mm to 5 mm or preferably a space of 2 mm to 3 mm.

The above-described first and second protective films 4, 5 may be formed for example by printing blast-resistant resin ink in a required pattern by screen printing and the like, or may be formed by applying a metal mask made of stainless steel (for example, SUS), aluminum (Al), copper (Cu), or iron (Fe) to the surface of the plate material or doing the like, or, further, the first and second protective films 4, 5 may be formed by attaching a resin film to the surface of the plate material.

In the formation of the above-described first and second protective films 4, 5, the first protective film 4 and the second protective film 5 may be formed by different methods and may be formed of different materials.

As an example, in the embodiment, both of the first and second protective films 4, 5 may be formed by screen printing using ink for screen printing.

Here, the film thickness of the first and second protective films 4, 5 varies according to the material and the like, however, as an example, the film thickness is 70 μm to 100 μm or preferably 90 μm to 100 μm, and it is preferable that the thickness of the first and second protective films be increased, because blasting time becomes longer as the thickness of the plate material 1 increases.

Abrasive

The cutting of the plate material 1 of the hard-brittle material on which the first and second protective films 4, 5 are formed as described above can be accomplished by ejecting ceramic-base abrasive grains (e.g. silicon carbide, aluminum oxide, zircon, zirconia, diamond, cerium oxide or the like) for common use in the cutting of the hard-brittle material, metal-base abrasive grains (e.g. stainless steel, cast steel, alloy steel, high-speed steel, tungsten carbide or the like), or FeCrB or the like, as an abrasive.

The size of the abrasive grains used as the abrasive may be appropriately selected according to various conditions such as the material of the hard-brittle material to be processed, the shape of the substrate to be cut out, and the material of the abrasive grains used, however, as an example, the abrasive grains having a median diameter of 20 μm to 100 μm may be preferably used.

Ejecting Method

The above-described abrasive together with compressed gas or compressed air in the embodiment is ejected from an ejection nozzle against at least the above-described cutting region in the plate material of the hard-brittle material.

The ejecting pressure of the compressed air used in the ejection of the abrasive may be appropriately changed according to the particle diameter or material of the abrasive used, however, preferably, the ejecting pressure lies between 0.2 MPa and 0.5 MPa or more preferably between 0.3 MPa and 0.5 MPa.

As the ejection nozzle used in the ejection, a circular nozzle having a circular ejection opening may be used, and when a relatively wide area is processed at the same time, a slit type nozzle (not shown) having an elongated rectangular ejection opening may be preferably used, and, when such a slit type nozzle is used, variations in the ejection speed of the abrasive in a length direction of the slit can be suppressed and uniform processing can be performed, as compared to when the circular nozzle is used.

The nozzle diameter of the ejection nozzle used lies between 3 mm and 10 mm in the case of the circular type (in the range of an opening area corresponding to the above-described diameter in the case of the slit type), or preferably lies between 6 mm and 10 mm in diameter.

The inclination of the ejection nozzle with respect to the surface of the plate material to be processed may lie between 45 and 90 degrees or preferably 60 and 90 degrees, or more preferably, the ejection takes place perpendicularly to the surface of the plate material 1 (at 90 degrees with respect to the surface of the plate material 1).

The ejection of the abrasive may be configured for example by arranging plural ejection nozzles side by side so that the plate material 1 can be covered throughout the entire area in its width direction (refer to FIG. 7), relatively moving the plate material 1 and/or the ejection nozzles in the longitudinal direction of the plate material 1, and ejecting the abrasive throughout the entire area of the plate material 1, or the abrasive may be ejected throughout the entire area of the plate material 1 by reciprocating the ejection nozzles on the plate material 1 or doing the like, and the configuration is not limited.

The ejection of the abrasive is first performed on any one of the front and back surfaces of the plate material 1, and after the cutting region 6 is cut to a depth of about half with respect to the thickness of the plate material 1, the abrasive is ejected from the other surface of the plate material 1 to completely remove the cutting region 6 and penetrate the plate material 1, and thereby cutout of the substrate 1 protected by the first protective film 4 is completed.

Cutout Device

Description will be given with reference to FIG. 2 with regard to an example of a configuration of a cutout device 10 suitable to cut out the hard-brittle substrate 2.

1. Overall Configuration

The cutout device 10 includes a plate material suspension jig 30 configured for moving the plate material 1 of the hard-brittle material to be processed in a state that the plate material 1 is suspended, an ejection nozzle 51 for back surface processing configured to eject the abrasive against the back surface of the plate material 1 suspended by the plate material suspension jig 30, a plate material mounting jig 40 configured to mount the plate material 1, and an ejection nozzle 52 for front surface processing configured to eject the abrasive against the front surface of the plate material 1 mounted on the plate material mounting jig 40, which are provided in a working space 12 surrounded by a cover 11. In an illustrated embodiment, the cutout device 10 further includes a transfer means 20 for transferring the plate material 1 disposed at an introduction position 12*a* for the plate material provided on one end of the cover 11 into the cover 11, and a control unit (not shown) configured to enable the means to cooperate with each other by controlling the operation of the respective means.

2. Transfer Means

Of structural equipments which form the cutout device 10 of the present invention, the transfer means 20 is provided in order to transfer the plate material 1 disposed at the introduction position 12*a* to a predetermined position in the working space 12, and may be configured by a known transfer means 20 (e.g. a roller conveyor in the illustrated example) such as a roller conveyor or a belt conveyor.

In the illustrated example, the transfer means 20 is provided extending from the introduction position 12*a* of the plate material 1 to a lower portion of an initial position of the plate material suspension jig 30 to be described later, and, when the plate material 1 to be processed is placed at the introduction position 12*a* provided on one end side of the cover 11, the plate material 1 can be moved below the plate material suspension jig 30 in the initial position (a position 12*b* in FIG. 2).

Of course, the transfer means 20 is not necessarily required to be provided and may be omitted, for example in the case of a configuration in which the plate material 1 can be manually disposed at the predetermined position in the working space 12 (below the plate material suspension jig 30 in the initial position).

3. Plate Material Suspension Jig

The plate material suspension jig 30 fixes by suction the front surface of the plate material 1 to be processed and can suspend the plate material 1 with its back surface floated, and enables the blasting of the plate material 1 from the back surface by suspending the plate material 1 in this manner.

In the illustrated embodiment, the plate material suspension jig 30 includes a suction fixing plate 31 to fix by suction the front surface of the plate material 1, an up-and-down movement mechanism 32 to move the suction fixing plate 31 up and down, and a traveling mechanism 33 to horizontally move the plate material 1 above the ejection nozzle 51 for back surface processing to be described later in a state that the plate material 1 is fixed by suction on the suction fixing plate 31. In the illustrated embodiment, the traveling mechanism 33 includes rails 33*a* and a pedestal 33*b* which travels along the rails 33*a*, and the suction fixing plate 31 is mounted to the pedestal 33*b* through the up-and-down movement mechanism 32 so that the suction fixing plate 31 can move up and down.

Figure 3:
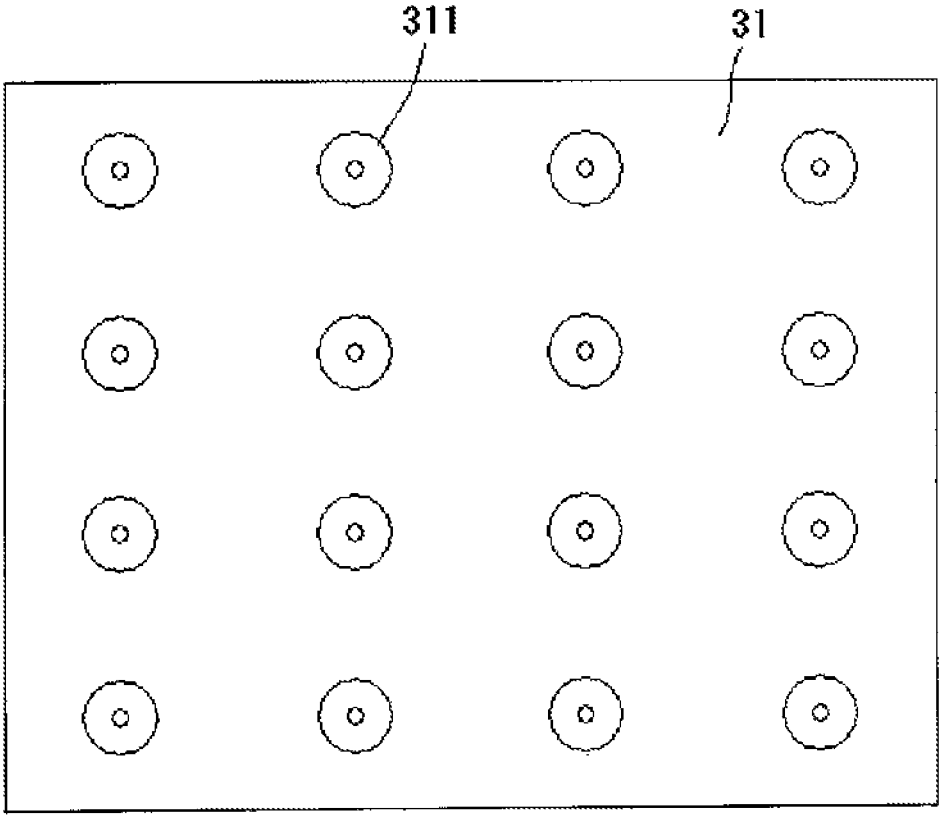
FIG. 3 is a bottom view of a suction fixing plate.

As illustrated in FIG. 3, the suction fixing plate 31 provided in the plate material suspension jig 30 includes a suction fixing pad 311 mounted on a bottom surface in a predetermined arrangement, and an inside of the suction fixing pad 311 is sucked by a suction means such as a vacuum pump (not shown) through a hose (not shown) communicating with the suction fixing pad 311 with an opening of the suction fixing pad 311 abutting the plate material 1, and thereby, the plate material 1 to be processed can be fixed by suction.

Figure 2:
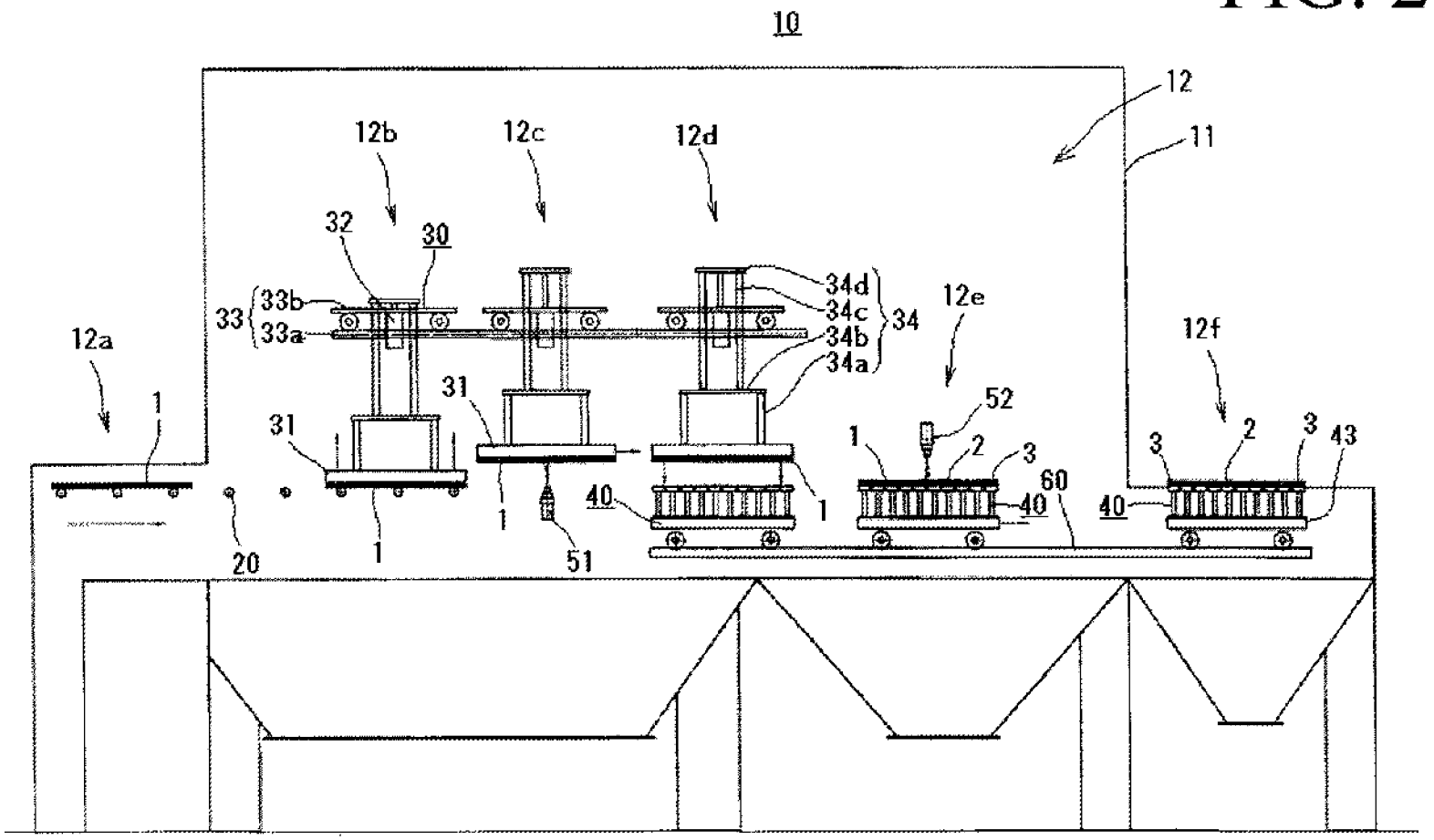
FIG. 2 is an explanation drawing of a cutout device of the present invention.

As illustrated in FIG. 2, an upper surface of the suction fixing plate 31 is linked to the pedestal 33*b* through a linking mechanism 34 and the up-and-down movement mechanism 32.

In the illustrated embodiment, four (4) columns 34*c* are stood on an intermediate linking plate 34*b* placed on an upper end of four (4) columns 34*a* mounted to the upper surface of the suction fixing plate 31. Though the detailed illustration is omitted, the columns 34*c* are fit in insertion holes provided in the pedestal 33*b* so as to be moved up and down so that the pedestal 33*b* can be moved synchronous with the four (4) columns 34*c*. Furthermore, an upper end linking plate 34*d* is placed on an upper end of the four (4) columns 34*c* to configure the linking mechanism 34 formed of the four (4) columns 34*c*. However, a configuration of the linking mechanism 34 is not limited thereto, and the linking mechanism 34 may have other configurations, provided that the suction fixing plate 31 can be held in a stable position during up and down movement.

The up-and-down movement mechanism 32 provided on the pedestal 33*b*, e.g. a piston rod of a hydraulic cylinder in the illustrated embodiment, is linked to an upper portion of the linking mechanism 34 formed as described above, e.g., the upper end linking plate 34*d* in the illustrated embodiment, and thereby, the suction fixing plate 31 can be moved up and down by the up-and-down movement mechanism 32.

In the embodiment, as described above, the hydraulic cylinder is provided as the up-and-down movement mechanism 32, however, the up-and-down movement mechanism 32 is not limited to the hydraulic cylinder, and an air pressure cylinder may be used, and various known structures employed as the up-and-down movement mechanism 32, such as a structure for moving the suction fixing plate 31 up and down, may be employed.

Of course, when an impact such as great vibration is applied to the plate material 1 fixed by suction while the suction fixing plate 31 is moving up and down, the plate material 1 may become damaged, and thus, it is desirable that a structure capable of relatively smooth up and down movement and also smooth starting and stopping operation be selected.

Although not shown, the plate material suspension jig 30 is provided with a driving mechanism (not shown) for allowing the pedestal 33*b* to travel on the rails 33*a* at a predetermined speed, and the plate material can pass at a certain speed above the ejection nozzle 51 for back surface processing to be described later.

The driving mechanism may be configured for example so that a motor for driving wheels provided on the pedestal 33*b* is mounted on the pedestal 33*b*, or a mechanism for pulling and/or pushing the pedestal 33*b* may be provided separately from the pedestal 33*b*, and various configurations may be employed, provided only that the pedestal 33*b* can be moved at a set certain speed.

The plate material 1 can be moved by the plate material suspension jig 30 from the position 12*b* in FIG. 2 through the ejection nozzle 51 for back surface processing (position 12*c*) to above the starting position of the plate material mounting jig 40 to be described later (position 12*d*).

4. Plate Material Mounting Jig

The plate material mounting jig 40 is a jig used for mounting thereon the plate material 1 which has undergone the back surface processing with being suspended by the plate material suspension jig 30 and blasting the front surface of the plate material 1. The plate material mounting jig 40 includes suction fixing bases for substrates 41 to respectively fix by suction and mount a portion of the plate material 1 covered with the first protective film 4, and a margin base 42 disposed at an outer peripheral position of a group of the suction fixing bases for substrates 41 and configured to mount a portion of the plate material 1 covered with the second protective film 5 (refer to FIG. 4).

Figure 4:
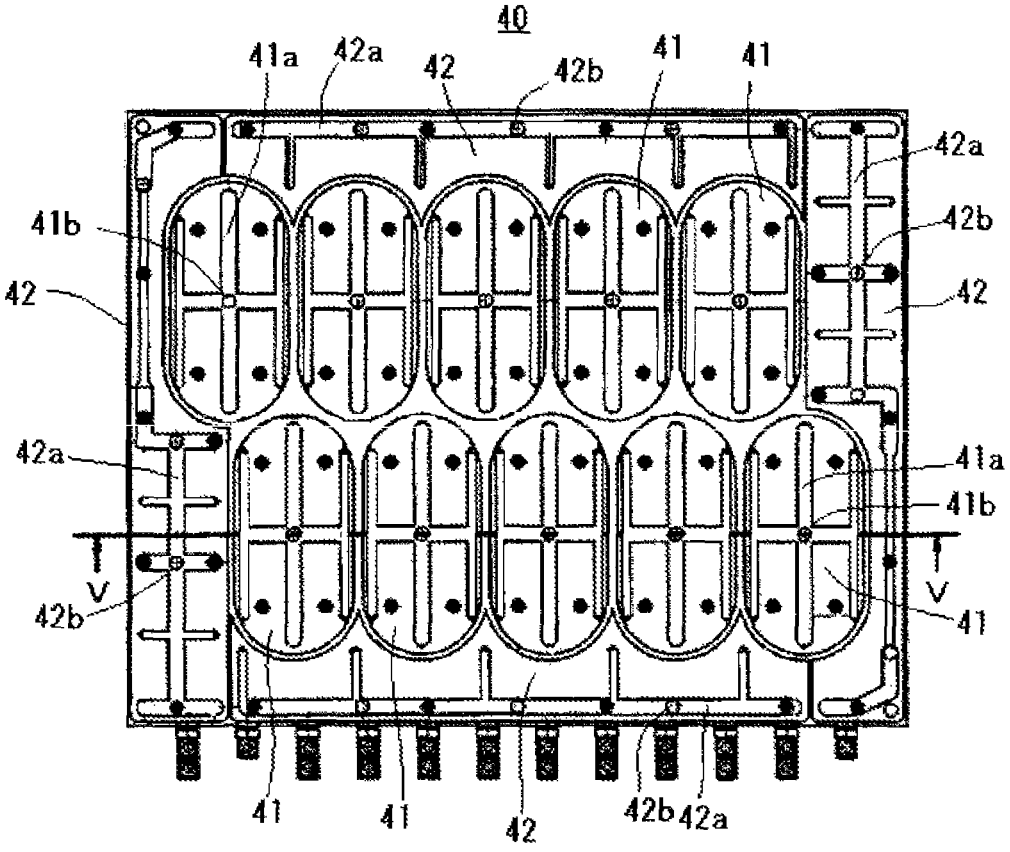
FIG. 4 is a plane view of a plate material mounting jig.
Figure 5:
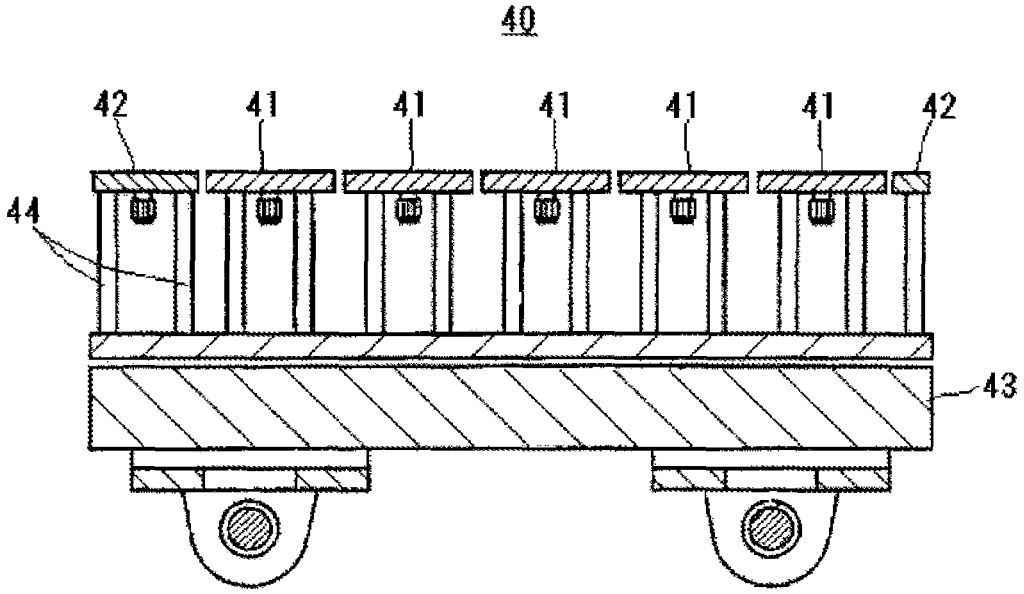
FIG. 5 is a cross-sectional view taken along line V-V in FIG. 4.
Figure 6:
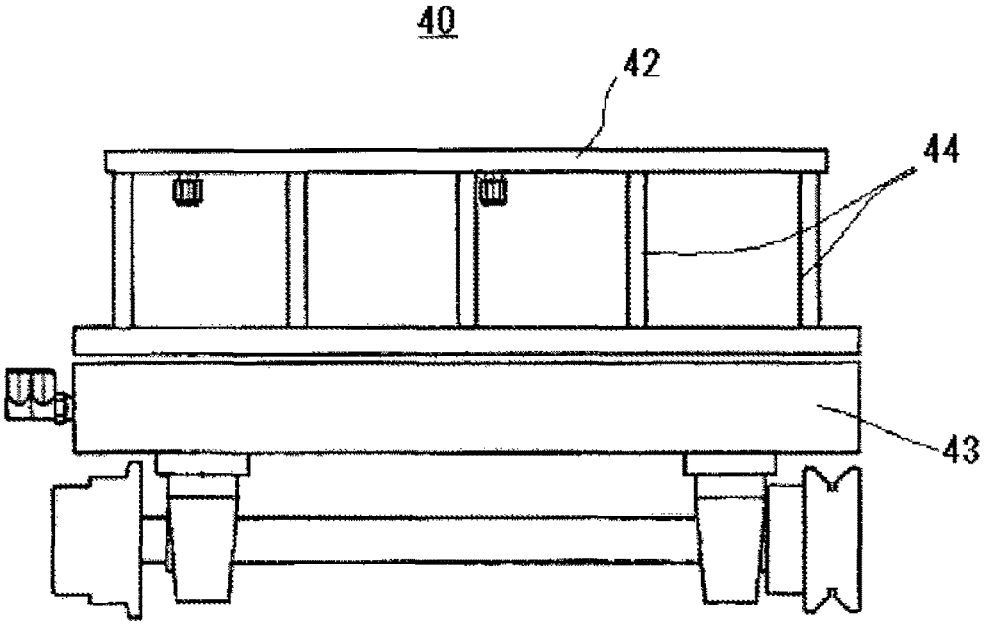
FIG. 6 is a side view of the plate material mounting jig.

The plate material mounting jig 40 illustrated in FIGS. 4 to 6 is further provided with rails 60 in the cover 11 so that the plate material 1 mounted on the plate material mounting jig 40 can pass below the ejection nozzle 52 for front surface processing disposed to a downward direction (refer to FIG. 2), and the plate material mounting jig 40 is provided with a pedestal 43 including wheels for traveling on the rails 60.

As illustrated in FIG. 4, the respective suction fixing bases for substrates 41 are formed in the same shape as the substrate 2 to be cut out in plane view. The suction fixing bases for substrates 41 are formed independently of each other and also formed independently of the margin base 42 to be described later. The number, layout pattern and height of the suction fixing bases for substrates 41 are the same with those of the substrates laid out on the plate material 1.

Also, the margin base 42 formed in the same shape as the margin (border) 3 covered with the second protective film in plane view is provided at the outer peripheral position of the group of the suction fixing bases for substrates 41 formed by arranging the suction fixing bases for substrates 41 in a predetermined pattern.

Then, the suction fixing bases for substrates 41 and the margin base 42 are disposed with being floated above the pedestal 43 with leaving a predetermined space inbetween through leg portions 44, and therefore, even when the abrasive is ejected to the plate material 1 by the ejection of the abrasive by the ejection nozzle 52 for front surface processing and the plate material 1 is penetrated by the cutting with the abrasive, a flow of the abrasive passing through the plate material 1 can pass downward through a space between the suction fixing bases for substrates 41, 41 or between the suction fixing bases for substrates 41 and the margin base 42, and the cut-out substrates 2 and the margin 3 can be mounted on the suction fixing bases for substrates 41 and the margin base 42 independently of each other.

The suction fixing bases for substrates 41, preferably, the suction fixing bases for substrates 41 and the margin base 42, are configured to fix by suction the portions of the substrates 2 and the margin 3 mounted thereon. In the illustrated embodiment, grooves 41*a*, 42*a* are formed in the surfaces of the suction fixing bases for substrates 41 and the margin base 42, through holes 41*b*, 42*b* communicating with the grooves 41*a*, 42*a* are formed through the thickness of the suction fixing bases for substrates 41 and the margin base 42, and the through holes 41*b*, 42*b* communicate with a suction means such as a vacuum pump (not shown) through a hose and the like (not shown) and suction is performed, and thereby the substrates 2 and the margin 3 mounted on the suction fixing bases for substrates 41 and the margin base 42 can be fixed by suction, and even when the substrates 2, 2 are cut off from each other and the substrate 2 is cut off from the margin 3, the relative positions therebetween do not change.

By the rails 60 provided in the cover 11 and the pedestal 43 which travels on the rails 60, the plate material mounting jig 40 can travel on the rails 60 so as to start at a position immediately below the plate material suspension jig 30 located at an endpoint position (position 12*d* in FIG. 2), pass below the ejection nozzle for front surface processing disposed to a downward direction (position 12*e* in FIG. 2), and travel to a removal position 12*f* provided on the other end side of the cover 11.

Incidentally, the pedestal 43 is provided with a wheel driving motor (not shown) mounted on the pedestal 43 and a driving mechanism (not shown) for pulling and/or pushing the pedestal 43, in order that the pedestal 43 can travel between the above-described positions (between 12*d* and 12*e*) and can pass through at least below the ejection nozzle 52 for front surface processing at preset certain speed.

5. Ejection Nozzle

The ejection nozzle 51 is provided below a traveling path of the plate material suspension jig 30 and the ejection nozzle 52 is provided above a traveling path of the plate material mounting jig 40.

The ejection nozzle 51 disposed below the traveling path of the plate material suspension jig 30 is the ejection nozzle for back surface processing, which is disposed with its ejection direction oriented upward and is provided to process the back surface of the plate material 1 mounted on the plate material suspension jig 30, while the ejection nozzle 52 disposed above the traveling path of the plate material mounting jig 40 is the ejection nozzle for front surface processing, which is disposed with its ejection direction oriented downward and is provided to process the front surface of the plate material 1 mounted on the plate material mounting jig 40.

Both the nozzles 51, 52 can eject the abrasive introduced as a fluid mixed with compressed gas, e.g. compressed air in the embodiment, from an abrasive supply source (not shown), and a configuration of an already known blasting apparatus may be employed as such an abrasive supply method.

Figure 7:
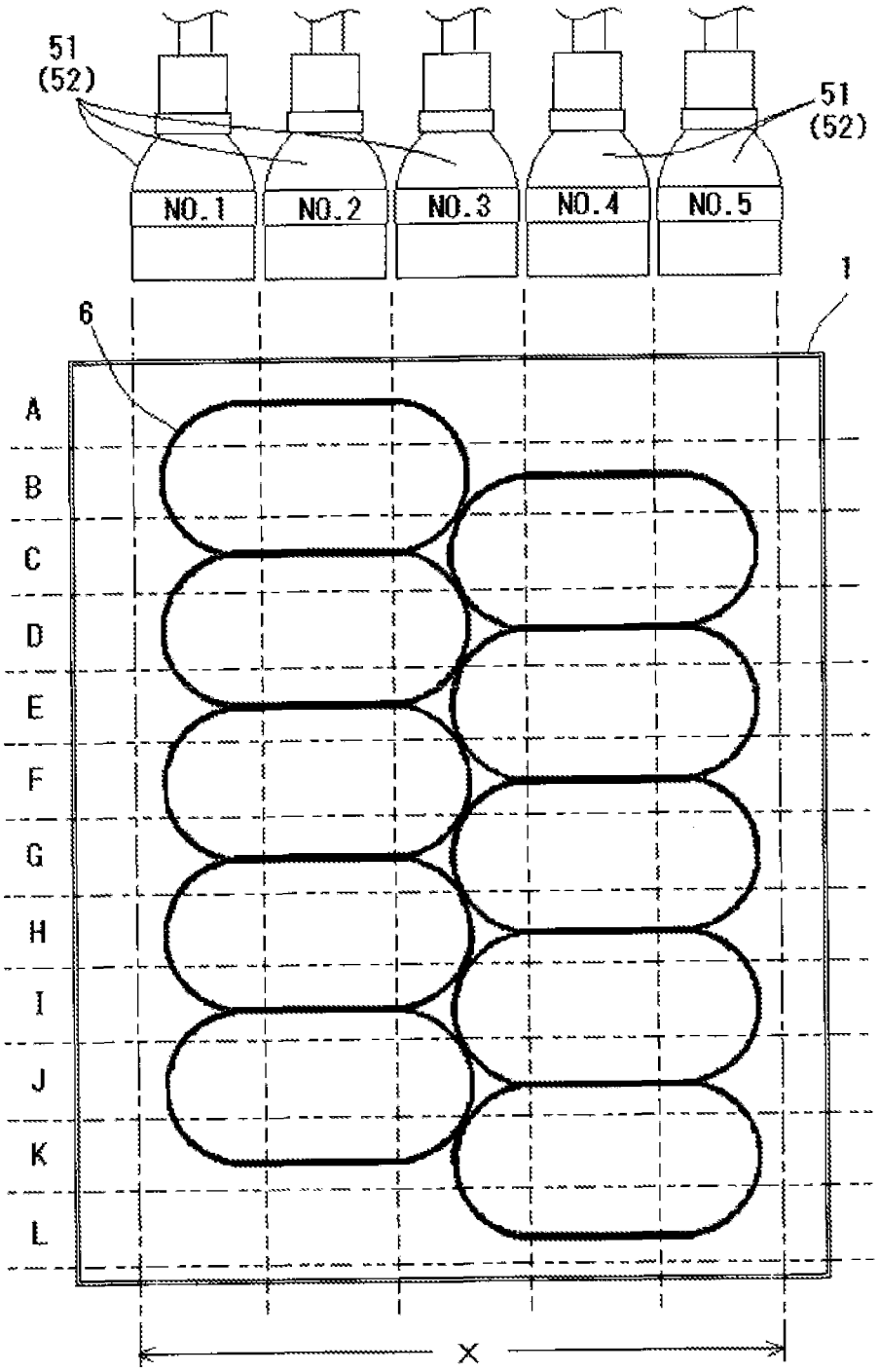
FIG. 7 is an explanation drawing showing dispositions of the plate material and ejection nozzles.

In the embodiment in which a subject to be processed is the plate material 1 provided with the cutting region 6 formed in the shape illustrated in FIG. 7, it is necessary that the ejection nozzles 51, 52 be disposed so that the abrasive can be ejected throughout the range of a region where the cutting region 6 is present in the width direction of the plate material 1 (region X in FIG. 7), and such an ejection range is ensured for example by arranging the plural ejection nozzles 51 (52) in the width direction of the plate material 1.

In this case, when the plate material 1 passes above (or below) the ejection nozzle 51 (52), in the present embodiment, a configuration is such that all the nozzles 51 (52) eject the abrasive. However, instead of this configuration, for example for the purpose of reducing the amount of abrasive used, in FIG. 7, control is performed so that the first to third nozzles eject the abrasive when an A block of the plate material 1 passes above or below the ejection nozzle 51 (52), the first, third, fourth and fifth nozzles eject the abrasive when a B block of the plate material 1 passes above or below the ejection nozzle 51 (52), the first, second, third and fifth nozzles eject the abrasive when a C block of the plate material 1 passes above or below the ejection nozzle 51 (52), and the other nozzles stop ejecting the abrasive, thereby the abrasive is ejected to a portion where the cutting region 6 is existed.

Control Unit

Operation of the members configured as described above is controlled by a control unit (not shown) to collectively control these members.

The control unit is configured for example by a microcontroller storing a predetermined program and the like, and the operation of the respective means is controlled based on position information on the plate material or the respective means detected by a sensor and the like, and thereby, operation of the cutout device 10 as described below as an example is achieved.

The plate material 1 on which the first and second protective films 4, 5 have been formed in a predetermined pattern is set in a predetermined direction at the introduction position 12*a* of the cutout device 10, and thereafter, for example, an operator inputs a start command by pressing a start switch or doing the like or the sensor provided at the introduction position 12*a* detects the disposition of the plate material 1, thereby the control unit restores the plate material suspension jig 30 and the plate material mounting jig 40 to their original positions where the jigs 30, 40 are moved to the starting positions of the traveling paths (the position 12*b* for the plate material suspension jig 30 and the position 12*d* for the plate material mounting jig 40), and starts the transfer device 20 to move the plate material 1 set at the introduction position 12*a* to a predetermined position in the working space 12.

When the plate material 1 moves to the predetermined position in the working space 12 (the position 12*b* in the example of FIG. 2), the control unit stops the transfer means 20, while the control unit operates the up-and-down movement mechanism 32 provided in the plate material suspension jig 30 to move the suction fixing plate 31 downwardly until the suction fixing plate 31 abuts the front surface of the plate material 1, and starts to suck an inside of the suction fixing pad 311 to allow the suction fixing plate 31 to fix by suction the plate material 1.

Upon completion of fixing by suction of the plate material 1 by the suction fixing plate 31, the control unit operates the up-and-down movement mechanism 32 of the plate material suspension jig 30 to move the suction fixing plate 31 upwardly.

Upon completion of the upward movement of the suction fixing plate 31, the control unit causes the pedestal 33*b* to travel and thereby starts to move the plate material suspension jig 30 along the rails 33*a*, and introduces the abrasive together with the compressed gas into the ejection nozzle 51 for back surface processing thereby to eject the abrasive to the back surface of the plate material 1 suspended by the plate material suspension jig 30 passing above the ejection nozzle 51 for back surface processing.

By the ejection of the abrasive, the cutting region 6 of the plate material 1 is cut to a depth of about half of the thickness of the plate material 1 from the back surface of the plate material 1, and in this state, the processing from the back surface of the plate material 1 is completed.

After passing above the ejection nozzle 51 for back surface processing, the plate material suspension jig 30 further moves to the position 12*d* to the right side of the sheet in FIG. 2, and, when the plate material suspension jig 30 reaches this position, the control unit finishes the movement of the plate material suspension jig 30 and operates the up-and-down movement mechanism 32 to move the suction fixing plate 31 downwardly.

The height of the bottom surface of the plate material at the position where the suction fixing plate 31 is lowered is set equal to the height of the mounting surface of the plate material mounting jig 40 at the starting position (position 12*d* in FIG. 2), and the endpoint position of the plate material suspension jig 30 is aligned with high accuracy with the starting point position of the plate material mounting jig 40, so that the layout position of the substrate 2 on the plate material 1 precisely conform to the disposition of the suction fixing bases for substrates 41 provided in the plate material mounting jig 40. Thus, by the downward movement of the suction fixing plate 31 described above, the substrates 2 laid out on the plate material 1 are mounted on the suction fixing bases for substrates 41 of the plate material mounting jig 40 in such a way as to exactly overlap with the suction fixing bases for substrates 41 in plane view.

Upon completion of the downward movement of the suction fixing plate 31 provided in the plate material suspension jig 30 as described above, the control unit causes the sucking means such as the vacuum pump (not shown) to suck insides of the grooves 41*a*, 42*a* through through-holes 41*b*, 42*b* provided in the suction fixing bases for substrates 41 and the margin base 42 of the plate material mounting jig 40 thereby the plate material 1 is fixed by suction to the plate material mounting jig 40, and fixing by suction of the plate material 1 by the suction fixing pad 311 provided on the suction fixing plate 31 of the plate material suspension jig 30 is finished After that, the control unit causes the plate material mounting jig 40 to travel rightward in the sheet of FIG. 2, and causes the ejection nozzle 52 for front surface processing to eject the abrasive from the front surface side of the plate material 1 mounted on the plate material mounting jig 40 passing below the ejection nozzle 52 until the plate material 1 is penetrated and the cutting region 6 is completely removed, thereby cutout of the substrates 2 is completed.

While each of the cut-out substrates 2 and the margin 3 are respectively kept mounted and fixed by suction on the suction fixing bases for substrates 41 and the margin base 42, the plate material mounting jig 40 continues traveling to the removal position 12*f* and stops at the position, and fixing by suction of the substrates 2 and the margins 3 by the suction fixing bases for substrates 41 and the margin base 42 is stopped, and the substrates 2 and the margins 3 after the cutout can be recovered.

Example 1

An example will be given below in which a glass plate is used as a substrate made of a hard-brittle material and a cover glass for protecting a liquid crystal display screen is cut out as the substrate.

Cutout Conditions

Hard-Brittle Plate Material

The glass plate (mother glass) used had a width of 400 mm, a length of 500 mm and a thickness of 0.7 mm, and substrates are laid out thereon and blanking is performed as illustrated in FIG. 1, and the first protective film and the second protective film were respectively formed in hatched portions.

Here, dimensions of the substrates to be cut out were such that a length was 160 mm, a width was 80 mm, and a diameter was 40 mm in curved portions of both ends.

Also, any of the widths of the cutting regions (spaces δ1, δ2, refer to an enlarged view in FIG. 1) were set to 2 mm, and the exposed width W in the peripheral portion of the plate material (refer to an enlarged view in FIG. 1) was set to 2 mm.

Protective Film

Both of the first and second protective films were formed by screen printing UV curing ink for screen printing having urethane acrylate as a resin content on the front surface of the mother glass, and then curing the ink by UV irradiation, thereby forming the first and second protective films having a film thickness of 90 μm.

Ejection Conditions

Abrasive used was abrasive grains (material: aluminum oxide) of #320 (having an average particle diameter of 60 μm), and the abrasive was ejected at an ejection speed of 1.1 kg/min, at an ejection pressure of 0.5 MPa, at an ejection distance of 80 mm, and at an ejection angle of 90° to the front surface of the plate material (perpendicularly to the front surface).

The ejection of the abrasive is performed from the bottom surface side of the plate material suspended by the plate material suspension jig 30 provided in the above described cutout device 10 until the thickness of the cutting region reaches about a half of the thickness of the plate material, and then, the ejection of the abrasive is performed from the front surface side of the plate material mounted on the above described plate material mounting jig 40 until the plate material is penetrated in the cutting region to cut off the substrates from each other and cut off the substrates from the margins completely.

Results of Cutout

In cutting out of the substrates under the above-described conditions, the substrates 2 and the margins 3 could be cut off with reliability without the plate material 1 being broken in the process of cutting out the substrates 2.

Figure 8:
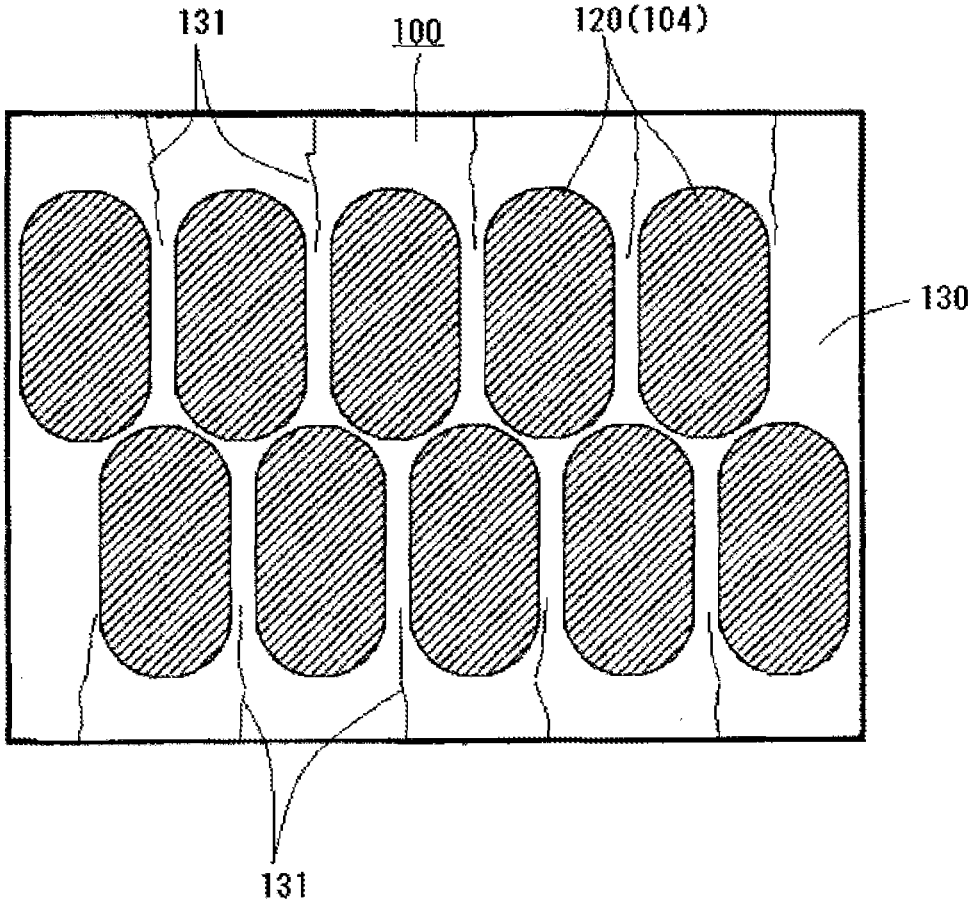
FIG. 8 is a plane view of a mother glass used to cut out a substrate by blasting (an example of failure).

Here, in the method described with reference to FIG. 8, cracks develop in the margin 3 of the plate material 1 during the ejection of the abrasive to one surface of the plate material, accordingly the substrates 2 could not be cut out. However, when the method described in Example 1 was used for cutting out the substrates, cracks do not develop both in the margin 3 of the plate material 1 and in the layout portions of the substrates 2, accordingly the substrates 2 could be cut out.

Therefore, it has been observed that the formation of masking (the second protective film 5) for the margin (border) 3 formed on the outer periphery of a group of the substrates 2 as well as the layout portions of the substrates 2 as a masking for the plate material 1, is extremely effective in preventing the plate material 1 from being fractured at the time of cutting out of the substrates 2 from the mother glass, and it has been observed that the formation of the second protective film 5 makes it possible to apply the blasting which has not hitherto been used to cut out of the substrates 2 from the plate material 1 of a hard-brittle material.

Example 2

Next, an example in which substantially spherical abrasive is used for cutting out a cover glass for protecting a liquid crystal display screen as the substrate 2 from the a glass plate made of a hard-brittle material will be given below together with Comparative Example.

Hard-Brittle Plate Material

The glass plate (mother glass) used had a thickness of 1.1 mm, and substrates are laid out thereon and blanking is performed as illustrated in FIG. 1, and the first protective film and the second protective film respectively were formed in hatched portions.

Also, each of the widths of the cutting regions (spaces δ1, δ2, refer to an enlarged view in FIG. 1) was set to 1 mm, and the exposed width W in the peripheral portion of the plate material (refer to an enlarged view in FIG. 1) were set to 2 mm.

Protective Film

Both the first and second protective films were formed by screen printing UV curing ink for screen printing having urethane acrylate as a resin content on the front surface of the mother glass, and then curing the ink by UV irradiation.

Processing Conditions

Processing conditions of Examples and details of the abrasive used, and results of evaluation of workpieces after processing are given in Table 1.

TABLE 1

| EXAMPLES | | |
|---|---|---|
| | Example 1 | Example 2 |
| Material of abrasive | FeCrB | High-speed steel bead |
| Processing conditions | Slit nozzle of 15 mm × 2 mm<br>Ejection pressure: 0.5 MPa<br>Ejection amount: about 550 g/min<br>Distance: 100 mm | Slit nozzle of 15 mm × 2 mm<br>Ejection pressure: 0.5 MPa<br>Ejection amount: about 550 g/min<br>Distance: 100 mm |
| Shape of abrasive, Particle size | Shape: substantially spherical<br>Particle size: Median diameter of 47 μm | Shape: substantially spherical<br>Particle size: Median diameter of 49 μm |
| Hardness of abrasive | HV 1200 | HV 700 to HV 900 |
| Processing speed (ratio) | 1 | 2 |
| Time required for cutting out a portable cover glass (Thickness: 1.1 mm) | 18 sec | 36 sec |
| Consumption of abrasive (ratio) | 1 | 1 |
| Specific gravity | 7.4 (true specific gravity) | 8.0 to 8.13 (true specific gravity) |
| Thickness of protective film | 80 μm (four (4) screen printings) | 80 μm (four (4) screen printings) |

Also, processing conditions of Comparative Examples and details of the abrasive used, and results of evaluation of workpieces after processing are given in Table 2.

TABLE 2

| COMPARATIVE EXAMPLES | | |
|---|---|---|
| | Comparative Example 1 | Comparative Example 2 |
| Material of abrasive | SUS bead | WA, A |
| Processing conditions | Slit nozzle of 15 mm × 2 mm<br>Ejection pressure: 0.5 MPa<br>Ejection amount: about 550 g/min<br>Distance: 100 mm | Slit nozzle of 15 mm × 2 mm<br>Ejection pressure: 0.5 MPa<br>Ejection amount: 400 g/min<br>Distance: 100 mm |
| Shape of abrasive, Particle size | Shape: substantially spherical<br>Particle size: Median diameter of 62 μm | Shape: polygonal<br>Particle size: Median diameter of 56 μm |
| Hardness of abrasive | HV 300 to HV 500 | HV 1300 to HV 1500 |
| Processing speed (ratio) | Comparison is impossible because cutting is impossible | 3 |
| Time required for cutting out a portable cover glass (Thickness: 1.1 mm) | — | 55 sec |

TABLE 2-continued

| COMPARATIVE EXAMPLES | | |
|---|---|---|
| | Comparative Example 1 | Comparative Example 2 |
| Consumption of abrasive (ratio) | — | 10 |
| Specific gravity | 7.6 (true specific gravity) | 1.76 to 1.95 (bulk specific gravity) |
| Thickness of protective film | — | 140 μm (seven (7) screen printings) |

Test Results and Verification

In Examples and Comparative Example 2, the substrates 2 could be cut out, however, in Comparative Example 1, the substrates 2 could not be cut out. Since the abrasive used in Comparative Example 1 had lower hardness (Hv 300 to Hv 500) than the abrasive in Examples, even if the specific gravity (true specific gravity) of the abrasive in Comparative Example 1 was substantially the same as the specific gravity in Examples, the glass could not be cut out.

Also, it has been observed that consumption of the abrasive in Examples is smaller than that of the abrasive in Comparative Example 2.

Also, it has been observed that, in Examples, the speed for cutting out the glass is faster than that of Comparative Example 2 (that is, in Examples, the time required for cutting out the substrates 2 is shorter than that of Comparative Example 2). The speed for cutting out the glass in Example 1 is about three times (3) faster than that in Comparative Example 2, and also, the speed for cutting out the glass in Example 2 is about 1.5 times faster than that that in Comparative Example 2.

Also, it has been observed that since the abrasive in Examples is substantially spherical, the abrasive does not stick in the protective films, or slightly stick in the protective films, as a result, consumption of the protective films is reduced, and the thicknesses of the protective films can be reduced as compared to Comparative Example 2 in which the polygonal abrasive is used. The resulting thin protective films enable to increase the processing accuracy (accuracy of cutout dimension) and further reduce the cost.

Here, considering Examples, it has been shown that the substantially spherical abrasive in Examples has high hardness and hence undergoes little deformation at the time of collision and collision energy is difficult to diffuse, and moreover, the abrasive has a high specific gravity and thus high collision energy can be concentrated on a point (a narrow range), accordingly the abrasive in Examples is suitable to cut out (grind) a hard-brittle material such as glass.

Further, verifying from the viewpoint of the cutout speed and the processing accuracy, although a larger particle size typically leads to higher collision energy and hence to a higher cutout speed, chipping becomes correspondingly larger and the processing accuracy (accuracy of cutout dimension) becomes lower, on the other hand, when the particle size is too small for the processing accuracy, the energy is reduced and thus damage more than necessary is not caused to the workpiece and the protective films, however, the cutout speed becomes slow. To increase the cutout speed while maintaining the processing accuracy, the abrasive with high specific gravity, high hardness and small particle size in Examples is suitable.

In this case, abrasive made of FeCrB is particularly suitable.

Thus the broadest claims that follow are not directed to a machine that is configured in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. A device for cutting out a hard-brittle substrate wherein a plurality of substrates to be cut out from a plate material made of a hard-brittle material is laid out on the plate material with leaving a space which is required for cutting by blasting; first protective films with blast-resistant property are formed on each of front and back surfaces of the plate material at a position where each of the substrates is laid out; second protective films with blast-resistant property are formed on outer edges of the substrates with leaving a space which is required for cutting by blasting; a margin of the plate material is covered so that an exposed width in a peripheral portion of the plate material is equal to or less than 5 mm thereby the plate material is a subject to be processed;

the device comprising:

a plate material suspension jig including a suction fixing plate for fixing by suction the front surface of the plate material and holding the plate material fixed by suction to the suction fixing plate in a state that the plate material is floated in midair;

a first ejection nozzle for back surface processing configured to eject abrasives to the back surface of the plate material suspended by the plate material suspension jig;

a plate material mounting jig for mounting the plate material after blasting from the back surface of the plate material; the plate material mounting jig including: a plurality of suction fixing bases for substrates with plane shapes corresponding to the substrates to be cut out, configured to fix by suction and mount thereon portions which are covered with the first protective films in the back surface of the plate material; and a margin base disposed at an outer periphery position of a group of the plurality of suction fixing bases for substrates, configured to mount thereon the portions which are covered with the second protective film in the plate material; and a second ejection nozzle for front surface processing configured to eject abrasives to the front surface of the plate material mounted on the plate material mounting jig.

2. The device for cutting out a hard-brittle substrate according to claim 1, wherein the plate material suspension jig includes an up-and-down movement mechanism and a horizontal movement mechanism for the suction fixing plate, the plate material mounting jig includes a traveling mechanism, and the device further comprises a control unit to cause the units to perform operation in which: the plate material suspension jig lowers the suction fixing plate from a starting position thereof and causes the suction fixing plate to fix by suction the plate material placed below the starting position; then the plate material suspension jig moves horizontally with the suction fixing plate moved up thereby to pass above the first ejection nozzle for back surface processing configured to eject the abrasive; then the plate material suspension jig moves to a position above the plate material mounting jig, lowers the suction fixing plate at the position thereby to mount the plate material on the plate material mounting jig, and thereafter release the suction by the suction fixing plate; and the plate material mounting jig starts to fix by suction the plate material, and travels and passes below the second ejection nozzle for front surface processing configured to eject the abrasive.

* * * * *